United States Patent [19]

Goldberger et al.

[11] 4,012,314

[45] Mar. 15, 1977

[54] TREATING COAL LIQUEFACTION PRODUCT OIL

[75] Inventors: William M. Goldberger; Bobby P. Faulkner, both of Columbus, Ohio

[73] Assignee: Battelle Memorial Institute, Columbus, Ohio

[22] Filed: Sept. 5, 1975

[21] Appl. No.: 610,639

[52] U.S. Cl. ..... 208/251 R; 208/8; 210/84

[51] Int. Cl.[2] ..... C10G 31/10

[58] Field of Search ..... 208/251 R, 8; 210/78, 210/84

[56] References Cited

UNITED STATES PATENTS

| | | | |
|---|---|---|---|
| 2,215,190 | 9/1940 | Pier et al. | 208/8 |
| 2,476,999 | 7/1949 | Orchin | 208/8 |
| 2,605,272 | 7/1952 | Hunn et al. | 210/511 |
| 2,728,714 | 12/1955 | Winkler et al. | 208/251 R |
| 3,240,566 | 3/1966 | Bullough et al. | 208/8 |
| 3,779,895 | 12/1973 | Wilson et al. | 208/251 R |

*Primary Examiner*—Delbert E. Gantz
*Assistant Examiner*—James W. Hellwege
*Attorney, Agent, or Firm*—Philip N. Dunson; C. Henry Peterson

[57] ABSTRACT

Methods of treating an oil derived by liquefaction of coal particles to separate unreacted solid matter therefrom and collect it in water or other aqueous medium, which comprise controlling the specific gravity of the oil to provide an oleaginous fluid having a substantially lower specific gravity than the aqueous medium, as by mixing the oil with a liquid that is miscible therewith and has a lower specific gravity, or by controlling the temperature of the oil, or both; contacting the fluid with the aqueous medium; moving the fluid in such a manner as to provide a substantial acceleration thereto in a direction to drive most of the solid matter away from the fluid and into the aqueous medium as by moving the fluid in a swirling path around an axis while maintaining a portion of the aqueous medium around at least a portion of the periphery of the path; and separating the aqueous medium with the solid matter contained therein from the fluid.

Typically a layer of the aqueous medium is formed with a layer of the fluid contiguous thereto, and the fluid layer is accelerated (as by centrifuging) to generate a force which acts to drive the particles from the fluid layer toward the aqueous layer; or the layers may be formed by injecting the fluid and the aqueous medium through separate, adjacent passageways into a cyclone separator whereby the layers are accelerated.

20 Claims, 4 Drawing Figures

TREATING COAL LIQUEFACTION PRODUCT OIL

BACKGROUND AND SYNOPSIS

This invention relates to a method of removing solids that are in suspension in the oil mixture derived from the liquefaction of coal.

Processes for liquefaction of coal involve the preparation of a suspension of finely ground coal in a coal derived oil or organic solvent and pumping this suspension into a high pressure reactor where it is heated to promote the dissolution of the organic components present in the coal. Hydrogen is generally added to the reactor system to increase the hydrogen to carbon ratio causing conversion of coal components into liquid fractions. The extent of conversion of the coal into oil depends on the type of coal and also on the process variables including temperature, pressure, residence time of the coal particles in the reactor, and the relative amounts of hydrogen and oil or solvent used with respect to the coal fed to the process. Conditions found effective for liquefaction of eastern bituminous coal are: temperature 700° F; pressure — 2000 psig; residence time of coal — 30 minutes; and, the ratio of oil to coal of 3:1. Hydrogen is added in a relative amount of approximately 10–20,000 scf/ton of coal. Under these conditions, up to 90 percent of the organic constituents of the coal can be converted to liquid products.

Processes to liquefy coal which are applicable to the basic method described are not new. Such liquefaction processes were developed and used in Germany during World War II. Similar processing has been in use in South Africa for more than 20 years for making gasoline from coal. The technology of coal liquefaction has been under development by various government and private organizations with the purpose of improving the processing and thereby reducing the cost of liquid fuels derived from coal.

A part of the coal liquefaction process that is recognized to be a difficult and costly step is the removal of the solid residue particles which remain in suspension in the coal derived oil leaving the hydrogenation reactor. These residue particles comprise the unreacted organic components and the nonreactive inorganic mineral matter associated with the incoming coal. These suspended residue particles must be removed to produce oils which meet fuel specifications for ash and sulfur. The term "ash" as used herein in general refers to ash-forming mineral or other inorganic matter, as contrasted with unreacted organic matter.

Various methods can be applied for separation of solids from liquids, including sedimentation, filtration, centrifuging, and possibly others. A number of physical factors, however, make these generally used methods extremely difficult to apply without adding significantly to the equipment, labor and maintenance costs for producing liquid fuels from coal. First, the particles of suspended solids are extremely fine in size with up to 50 percent or more of the material less than about 5 to 10 microns. Sedimentation of these fines in the oil would be impractical because of the large area required to provide the needed settling time. Sedimentation therefore would require an excessive inventory of the product oil. Moreover, because the viscosity of the coal derived oils increases as the oil cools, the solids separation must be accomplished at temperatures above about 500° F to assure adequate fluidity of the oil.

However, the oil contains a considerable amount of components that are volatile at elevated temperature, therefore it is necessary to maintain the oil under pressure of at least about 150 psig for solids separation operations.

Solids separation methods now employed in coal liquefaction plants include filtration aand centrifugation or hydrocloning. Filtration appears to be a preferred method because it allows a higher recovery of clear oil product and is effective in removing submicron size particles of the residue. Although the unit operation of filtration is well established in the mineral and chemical process industries, it is usually conducted at near-ambient conditions. Filtration of the hot oils under pressure requires filter apparatus of advanced and special design not now available in the high capacity range of major interest in coal liquefaction. In addition, filtration of the hot oils is complicated by the need to use a filter aid such as diatomaceous earth to prevent the fine particles from rapidly clogging the filter screen. The filter, however, must be periodically backwashed and a fresh "pre-coat" of filter aid developed. Thus the filtration cycle includes backwashing, pre-coat preparation, filtration, cake removal, and cake drying. Of a total cycle time of about 90 minutes, the actual filtration time is only about 30 minutes. In effect, filtration of the hot oils requires a substantial product inventory and high capital investment in special pressure filters, heated liquid storage tanks, pumps, and control instrumentation.

The practice of the present invention permits the continuous and essentially complete removal of solids suspended in oils derived by coal liquefaction. The coal derived oils containing the suspended residues are contacted directly with water in a manner to cause the suspended solids to be transferred from the oil phase into the water phase. Once contained suspended in the water phase, the resulting water slurry of the residue solids can be cooled to ambient conditions of temperature and pressure and the solids separated by relatively low cost conventional methods of thickening, flocculation, filtration etc. using standard apparatus of proven design now available for operations at the full capacity of projected coal liquefaction plants. By effecting a rapid transfer of the mineral residues from the oil to the water, very little of the product oil is required to be in inventory within the process system and this greatly improves the process economy. Moreover, because the water is a relatively inexpensive agent, conventional thickeners may be employed at ambient conditions to take advantage of low cost gravity means for clarification of water for reuse and for preconcentration of the mineral residues for subsequent filtration with little or no loss of product oil in the filtration cycle.

Utilizing the methods of this invention, mineral solids contained in suspension in coal derived oils can be removed from the oil by direct contact of the hot oil with water under pressure. To enhance the overall transfer rates, it is desirable to incorporate a centrifugal action to increase the rate of coalescense of any dispersed water phase and to accelerate the migration of the mineral solids through the oil-water interface into the bulk water phase.

In conducting the process of this invention, it is desirable to establish conditions such that the oil phase has a substantially lower density than water. If there is insufficient density difference, agitated contact of the oil and water can result in the formation of an emulsion with resulting difficulty in separation of the oil and water phases.

It is known that the density of the coal derived oil phase decreases with increasing temperature. At moderate temperature, for example 150° F, a coal derived oil may have a density of about 1.152 which is greater than that of water. Thus, if this coal oil and water are intimately mixed at 150° F, and then allowed to settle at this temperature, two phases will form, i.e., a heavier, lower oil phase and a lighter upper water phase. Mineral residue particles originally present and suspended in the oil will tend to remain in the oil phase or adhere to the resulting oil-water interface. In this case, with the oil heavier than water, any attempt to effect the transfer of the residue particles into the bulk water phase by centrifugal action or by gravity means will cause the mineral solids to return to the heavier oil phase without achieving the desired removal. Therefore, the practice of this invention may involve mixing of the coal derived oil with water and desirably includes maintaining and controlling the temperature of the oil-water mixture so as to ensure that the coal oil phase will have a desired density which is lighter than water. It has been found that for some oils temperatures of around 500° F are approximately optimum to help achieve the fluidity which assures the rapid separation of oil and water phases after mixing. Such high temperature also helps to fulfill the requirement that the coal oil be lighter, than the water, or other aqueous medium employed, for effective separation of the phases. Application of centrifugal force, as for example by hydrocyclone or centrifuge, then pulls the wetted particles through the oil-water interface into the heavier bulk water phase and efficiently and rapidly removes these particles from the oil phase.

Basically, therefore, the processes of this invention are concerned with the removal of mineral residue solids suspended in the coal derived liquefaction oils by controlling the temperature, dilution of the oil by a lighter liquid which is miscible with the oil but not miscible with the water or other aqueous medium, and/or other conditions causing the density of the oil to be substantially lighter than water and accelerating the oil to cause rapid transfer of the mineral solids from the oil into the bulk water phase.

The coal extract liquid at ambient temperature may be heavier than water, but if this oil is diluted by first adding a suitable organic solvent, such as benzene, the resulting mixture can be made lighter than water at ambient temperature. Subsequent application of centrifugal action enables mineral residue solids to be rapidly and efficiently removed from the coal oil. It has been found that an effective amount of added solvent to accomplish the stated purpose is of the order of a volume ratio of 1:1 solvent to coal oil.

Separation may also be enhanced by control of the chemistry of the system, for example the pH, which may induce flocculation and thereby enhance the effect of centrifugal action in causing the suspended particles to migrate from the oil to the water phase. In addition, certain chemical agents may be added to affect and control the viscosity of either the oil or the water phase to accelerate particle transfer or to cause the particles to be more rapidly wetted by water or to reduce and minimize the quantity of oil phase occluded on the mineral solids' surface and present after transfer of the particles from the oil to the water.

The relative quantities of oil-solvent and water can be controlled as well as the temperature and chemistry of the system to assure optimum process rates and recovery.

SUMMARY

A typical method according to the present invention for treating an oil derived by liquefaction of coal particles, to separate unreacted solid matter therefrom and collect it in an aqueous medium, comprises controlling the specific gravity of the oil to provide an oleaginous fluid having a substantially lower specific gravity than the aqueous medium, contacting the fluid with the aqueous medium, moving the fluid in such a manner as to provide a substantial acceleration thereto in a direction to drive most of the solid matter away from the fluid and into the aqueous medium, and separating the aqueous medium with the solid matter contained therein from the fluid. The specific gravity controlling step typically comprises either mixing the oil with a liquid that is miscible therewith and has a lower specific gravity, or controlling the temperature of the oil, or both.

The method typically comprises moving the fluid in a swirling path around an axis while maintaining a portion of the aqueous medium around at least a portion of the periphery of the path.

The method may comprise forming an interface between the fluid and the aqueous medium, and positioning the interface so that the solid matter is driven through the interface into the aqueous medium.

A typical method comprises forming a layer of the aqueous medium with a layer of the fluid contiguous thereto, and accelerating the fluid layer to generate a force which acts to drive the particles from the fluid layer toward the aqueous layer, as by moving the fluid layer in a swirling path around an axis, with a least the major portion of the fluid nearer the axis and the major portion of the aqueous medium more remote from the axis. This may comprise centrifuging the fluid layer, or it may comprise forming the layers by injecting the fluid and the aqueous medium through separate, adjacent passageways into a cyclone separator whereby the layers are accelerated. The layer forming and accelerating steps may comprise centrifuging the fluid and the aqueous medium together.

The aqueous medium typically comprises essentially water, and the miscible liquid typically comprises a light end fraction obtained by fractionating by distilling the original coal derived oil. Typically about 0.5 to 6 parts by volume of the light end fraction are mixed with one part of the oil to produce the oleaginous fluid. Another typical miscible liquid may comprise benzene, toluene, xylene, or kerosene. Typically about 0.5 to 3 parts by volume of benzene are mixed with one part of the oil to produce the oleaginous fluid. The acceleration of the fluid typically is at least about 100 times that of gravity (100g), and preferably in the range from 100g to 250g.

Typically the unreacted solid matter includes both hydrocarbonaceous particles and inorganic particles which are the ash forming particles, and the method comprises selectively removing a major portion of the ash particles from the fluid while allowing a substantial portion of the hydrocarbonaceous particles to remain in the fluid. Typically the average density of the ash forming particles is greater than that of the hydrocarbonaceous particles, and the selective removal comprises limiting the accelerating movement of the fluid to a predetermined level at which a major portion of the inorganic particulate matter has been transferred to the water and thereby removed and while a substantial portion of the hydrocarbonaceous matter remains in the coal oil fluid. In other words, the solid matter typically comprises denser inorganic ingredients and less dense organic matter, and the fluid typically is accelerated for a predetermined time until a major portion of the inorganic ingredients have been removed and while a substantial portion of the organic matter remains in the liquid.

DRAWINGS

DETAILS

Figure 1:
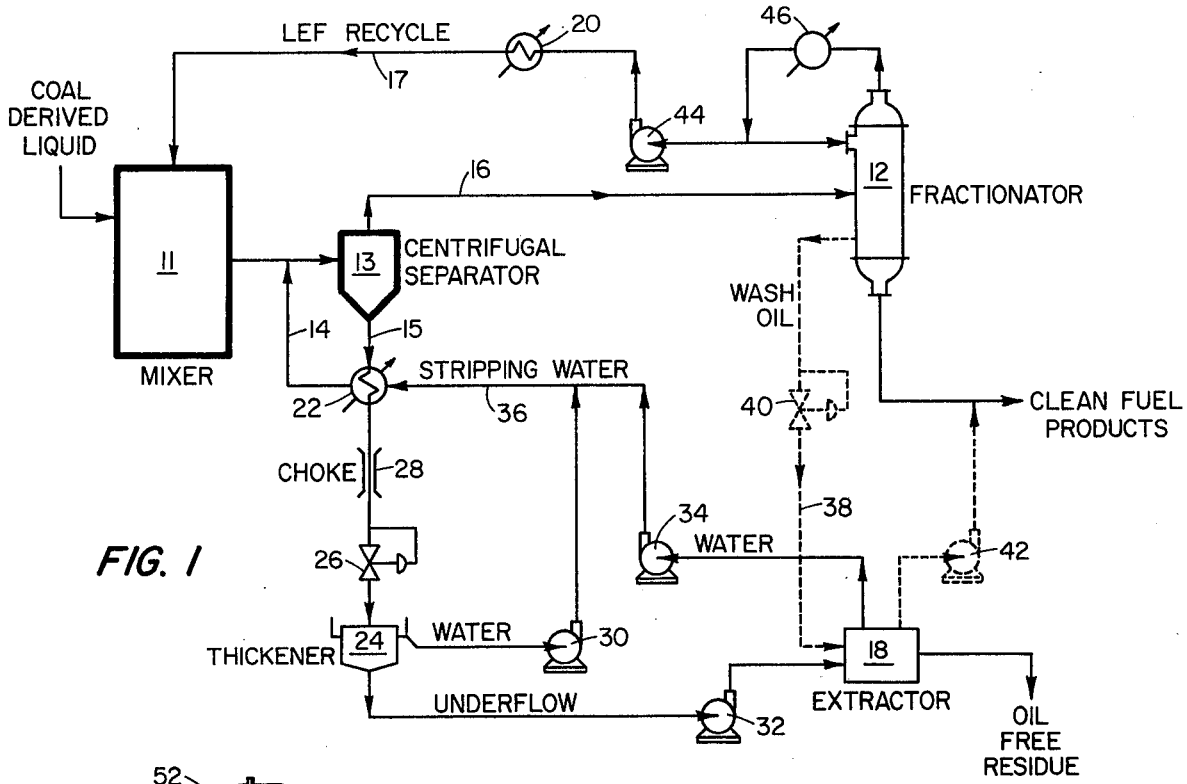
FIG. 1 is a flow diagram illustrating a presently preferred method according to the present invention.

Referring to FIG. 1, a presently preferred method according to this invention involved dilution of the liquefaction oil fed from the digestion reactor (not shown) to a mixer 11 by approximately twice its volume of a light solvent oil obtained as a Light End Fraction (LEF) from distillation of the product coal oil in a fractionator 12. This dilution serves to decrease the specific gravity of the oil and make it substantially lower than that of water. The diluted oil mixture containing suspended solids is then introduced into a centrifugal separator 13 (typically either a hydroclone or a centrifuge), and water is added, as indicated at 14, to the separator 13 in a typical amount approximately twice that of the total diluted oil volume. The centrifugal action is sufficient to cause the solids suspended in the oil phase to migrate into the heavier water phase. The separator 13 typically provides an acceleration force of at least about 100 times that of gravity, and limits the degree of turbulence between oil and water phases to minimize or, if possible, eliminate the formation of an emulsion or gel at the oil-water interface. The water phase 15 from the separator 13 contains substantially all the solids. A clear, essentially solids-free oil 16 flows from the separator 13 to the distillation column (fractionator) 12, to recover the light-end fraction 17 for return to the front end of the system. The separated solids typically contain occluded oil equivalent to about three times the weight of the oil-free solids. A means 18 for extracting and recovering this occluded oil, for example by washing with a fraction of the product oil, may be provided to avoid oil losses.

Centrifuge experiments have shown that a satisfactory separation can be achieved with a force of about 100g to 250g. Hence a centrifuge device or combination of centrifuges may be used as the separator 13 to accomplish the solids transfer in the continuous process of FIG. 1. However, centrifuges are complex and expensive machines, and they are not normally manufactured to the specifications required for operation at the typical elevated temperature and pressure conditions of this process. Because of the simplicity of construction and operation, the use of a hydroclone to develop the centrifugal force needed in the water-stripping process offers several advantages. However, in an oil-water system, the shear action of the hydroclone can lead to emulsification. Moreover, the many factors that affect surface tension will influence the degree of emulsification that may occur. The system may be quite sensitive to factors such as temperature, surfactants, trace elements, and pressure changes.

A commercial hydroclone separation system may involve banks of cyclones arranged to allow multiple passes, to increase the retention time. It may be designed more specifically to deliver various intermediate fractions obtained at different stages of the separation.

Figure 2:
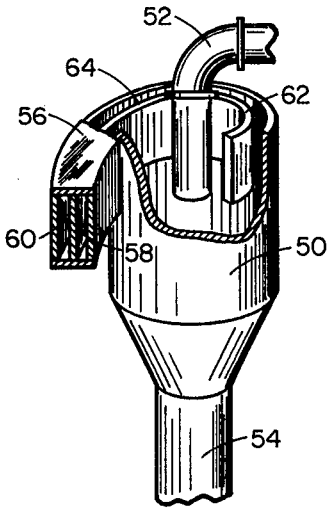
FIG. 2 is a schematic, perspective view of a hydroclone which has been modified to enable it to effectively perform certain steps in a method according to the invention.

FIG. 2 illustrates one way in which a conventional hydroclone can be modified in order to reduce the turbulence between oil and water phases for more effective separation of unreacted solid matter from the oleaginous fluid obtained by controlling the density of the original coal-derived oil through heating, as by a heat exchanger 20 (FIG. 1), dilution or other method or combination of methods. The basic hydroclone may conveniently be of the type using an involuted feed configuration to minimize turbulence, which is marketed commercially by Krebs Engineers, Menlo Park, California.

The hydroclone 50 shown in FIG. 2 has been modified to provide it with a split, involuted feed passage arrangement 56. This arrangement includes a first inside passage 58 for receiving the oleaginous fluid and a second, outside passage 60 for receiving the aqueous medium (termed stripping water in the flow diagram of FIG. 1). The two liquids fed to the hydroclone 50 are separated by an involuted barrier 62 as they enter the hydroclone so as to form two separate but contiguous layers where the barrier 62 terminates.

These layers of liquid move into the cone section of the hydroclone 50 where the oleaginous fluid 5 subjected to substantial acceleration as the oleaginous fluid layer and the aqueous medium layer move in a swirling path around the axis of the hydroclone. At least during a substantial part of the time the acceleration is applied to the oleaginous fluid, the layer formation is preserved, keeping a major portion of the fluid nearest the hydroclone axis and the major portion of the aqueous medium more remote from the axis. The interface between the two liquids is thus positioned so that the force exerted on the solid particles due to the acceleration of the fluid can drive the particles from the fluid, through the interface and into the aqueous medium (stripping water). Similar effects can also be achieved by centrifuging the liquids, as above noted, whereby layers can be effectively formed and their interfaces properly positioned during the acceleration of the liquids due to the normal swirling action produced in the centrifuge, but at increased cost and with greater complexity.

The final result of the hydrocloning is to separate the oleaginous fluid, which passes out through the overflow conduit 52, from the aqueous medium. The medium passes out through the underflow conduit 54.

Figure 3:
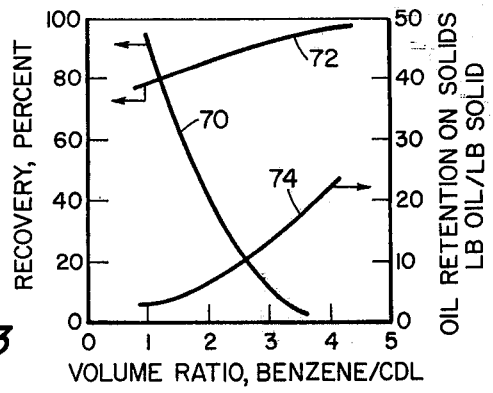
FIG. 3 is a graph showing some experimentally determined relationships demonstrating the effects of various ratios of benzene to coal-derived liquid on a method according to the invention.

FIG. 3 illustrates some results of a series of centrifuging experiments which were performed using benzene to dilute the coal derived liquid (CDL) and to lower its density. In these experiments, a constant amount of the CDL was diluted with varying proportions of benzene. The diluted CDL was poured into a centrifuge tube containing water. The oil-water system was then centrifuged at 1000 rpm for 10 minutes. The upper CDL/organic layer was separated from the bottom aqueous layer containing solids and both layers were analyzed for their solids and the CDL contents. The results are given in Table 4. Mixing of the oil and water phases was not done to avoid formation of a gel found previously to occur with addition of benzene.

TABLE A

CENTRIFUGE DATA - SOLVENTS

| Exp. No. | CDL, ml | Diluent: Organic | Diluent: Volume ml | Ratio Organic/CDL | Distribution, weight percent: CDL: Oil Layer | CDL: Aqueous Layer | Solids: Oil Layer | Solids: Aqueous Layer | Weight Ratio CDL/Solids: Oil Layer | Weight Ratio CDL/Solids: Aqueous Layer | Percent Ash: Oil Layer | Percent Ash: Aqueous Layer | Remarks |
|---|---|---|---|---|---|---|---|---|---|---|---|---|---|
| 76 | 25 | Benzene | 25 | 1 | 80 | 20 | 7 | 93 | 145 | 3 | 32.9 | 36.9 | CDL diluted with organic poured on water and centrifuged for 10 min at 1000 rpm. |
| 77 | 25 | Benzene | 50 | 2 | 80 | 20 | 58 | 42 | 17 | 6 | 33.7 | 33.92 | |
| 78 | 25 | Benzene | 75 | 3 | 92 | 8 | 95 | 5 | 12 | 21 | 33.8 | 28.6 | |
| 82 | 20 | Benzene | 80 | 4 | 96 | 4 | 95 | 5 | 13 | 17 | 30.3 | 25.6 | " |
| 84 | 25 | Kerosene | 25 | 1 | 80 | 20 | 57 | 43 | 14 | 5 | 23.3 | 23.6 | " |
| 85 | 25 | Kerosene | 50 | 2 | 67 | 33 | 47 | 53 | 14 | 8 | 24.1 | 24.6 | " |
| 86 | 25 | Kerosene | 75 | 3 | 97 | 3 | 97 | 3 | 10 | 16 | 24.4 | 28.5 | " |
| 124 | 25 | LEF[a] | 50 | 2 | 86 | 14 | 7 | 93 | 448 | 4 | 1.61 | 40.8 | CDL diluted with LEF, mixed with 500 cc water using a stirrer at 2000 rpm for 5 minutes. Emulsion formed was centrifuged at 1000 rpm for 20 minutes. |
| 125 | 25 | LEF | 75 | 3 | 85 | 15 | 20 | 80 | 273 | 12 | 33.2 | 41.1 | |
| 126 | 25 | LEF | 100 | 4 | 96 | 4 | 42 | 58 | 163 | 5 | 32.8 | 37.2 | |
| 136 | 25 | LEF | 50 | 2 | 93 | 7 | 26 | 74 | 162 | 4 | 8.4 | 34.3 | |
| 136A | 25 | LEF | 50 | 2 | 93 | 7 | 25 | 75 | 200 | 5 | 11.5 | 39.3 | |
| 135 | 25 | LEF | 75 | 3 | 90 | 10 | 18 | 82 | 296 | 7 | 18.1 | 38.0 | " |
| 135A | 25 | LEF | 75 | 3 | 95 | 5 | 20 | 80 | 358 | 5.5 | 13.3 | 43.2 | " |
| 133 | 25 | LEF | 100 | 4 | 96 | 4 | 10 | 90 | 650 | 3 | 3.8 | 35.9 | " |
| 133A | 25 | LEF | 100 | 4 | 96 | 4 | 15 | 85 | 400 | 4 | 19.9 | 43.9 | " |
| 146 | 25 | LEF | 125 | 5 | 94 | 6 | 28 | 72 | 291 | 8 | 29.5 | 39.7 | " |
| 147 | 25 | LEF | 150 | 6 | 94 | 6 | 18 | 82 | 566 | 7 | 26.6 | 39.6 | " |

[a]LEF = Light-End Fraction.

The Light End Fraction (LEF) oil obtained from the vacuum flash distillation of the CDL (Having a specific gravity of 0.91 and a boiling point of 160° C) was also tried as a diluent in a separate series of experiments. Mixing the LEF oil-diluted CDL with water, using a stirrer, did not yield a gel; instead, a brown colored oil-water emulsion was formed. It was noted that this could be broken centrifuging.

For the centrifuge experiments, 25 ml of the CDL was diluted with varying proportions of the Light End Fraction (LEF) oil. The CDL-LEF mixtures were then mixed separately with about 500 ml water, using a stirrer at 1500 rpm for 5 minutes. The resulting emulsions were centrifuged at 1000 rpm for 20 minutes, causing them to separate into a top oil layer, a middle clear water layer, and a solids residue at the bottom of the centrifuge tube. The oil layer, water layer, and solids were separated and analyzed.

Table A lists the experimental data obtained with diluents including benzene and kerosene solvents and LEF oil. With an increase in dilution of the CDL with benzene and kerosene, the amount of solids that migrated into the aqueous phase decreased. FIG. 3 shows by curve 70 the percentage of solids and weight ratio CDL/solids transferred to the aqueous layer, curve 72 shows the percentage oil recovery in the oil phase, and curve 74 shows the oil retention on the solids. These values are plotted with respect to the ratio of benzene to CDL. At a benzene-to-CDL ratio of 3 (Experiment 78) the amount of solids that had migrated into the aqueous phase was small (5 percent of the total solids) compared to the benzene-to-CDL ratio of 1 (Experiment 76) where approximately 93 percent of the total solids migrated into the aqueous phase. A possible explanation of this behavior may be that an excess of benzene caused gel formation at the organic-aqueous interface, hindering the migration of solids into the aqueous phase. In the case of kerosene as indicated by Table A, the amount of solids that migrated into the aqueous phase was small compared to the case with benzene, e.g., at a kerosene-to-CDL ratio of 1 (Experiment 84) only, 43 percent migrated into the aqueous phase; and, at a ratio of 3 (Experiment 86) the amount of solids that migrated into the aqueous phase was neglible. The reason for the poorer results obtained with kerosene than with benzene is not established. However, increased gel formation may have been a factor.

Figure 4:
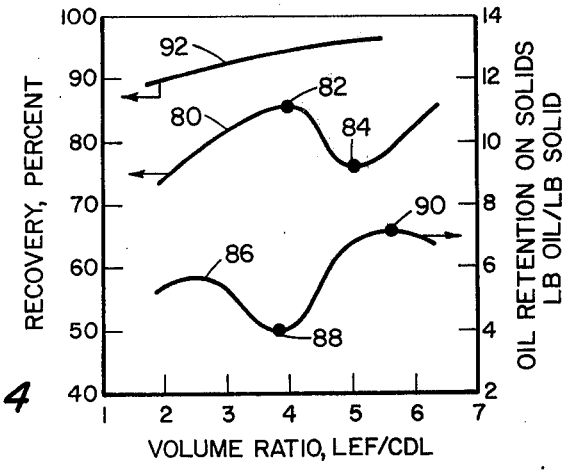
FIG. 4 is a graph similar to that of FIG. 3 showing corresponding experimental data obtained with a light end fraction of the coal derived liquid used as a diluent, rather than benzene.

FIG. 4 shows some results of centrifuge experiments conducted with Light End Fraction (LEF) oil as diluent. These experiments show an increase in the effectiveness of the removal of solids into the aqueous phase with increasing dilution of the CDL. Experiments using LEF-to-CDL ratios of 2, 3, and 4 were repeated to check the reproducibility of the data, and it was found that the data reproduces within reasonable experimental limits. As shown by curve 80, the amount of solids recovered in the aqueous phase reached a maximum 82 (approximately 90 percent) at a LEF-to-CDL ratio of 4 (Experiment 133). Above this ratio, the total percent solids recovered in the aqueous phase decreased to a low point 84. The weight ratio curve 86 for oil to solids in the aqueous phase shows a minimum at a LEF-CDL ratio of 4. Insofar as curve 86 and the accompanying data are concerned, the results using weight ratios of 3 or 4 in the duplicate experiments are not greatly different from the other weight ratio values obtained at lower dilution. However, the analysis showed a minimum amount of ash associated with the centrifuged oil in the present case. Curve 92 shows that significantly higher values are obtained for the oil recovery in the oil phase, by comparison with the benzene experimental values shown by the similar curve 72 of FIG. 3. Table B lists the analysis of the products obtained with centrifugation of the LEF-CDL (4:1) mixture with water (Experiment 133). It shows that the centrifuged solids amount to about 4 percent of the whole product. They consist of about 12 percent ash, 14 percent organic benzene insolubles (unreacted carbon), with the balance of 72 percent made up by oil. The top oil layer consist of 99 percent oil, 0.97 percent organic benzene insolubles, and 0.03 percent ash by weight.

TABLE B

ANALYSES OF CENTRIFUGED PRODUCTS
LEF/CDL Volume Ratio = 4

| Exp. No. | Product | Analysis, percent by weight: Percent Weight | Benzene Insoluble Organic Solids[a] | Ash | Benzene Soluble Oil[b] | Distribution percent by weight: Benzene Insoluble Organic Solids[a] | Ash | Oil[b] |
|---|---|---|---|---|---|---|---|---|
| 133 | Centrifuged Solids Residue | 4.0 | 16.0 | 12.0 | 72.0 | 40.74 | 95.0 | 3.00 |
| | Centrifuged Oil | 96.0 | 0.97 | 0.03 | 99.0 | 59.26 | 5.00 | 97.00 |
| | Calculated Feed | 100.0 | 1.57 | 0.50 | 97.92 | 100.00 | 100.00 | 100.00 |
| 133A | Centrifuged Solids Residue | 4.0 | 11.38 | 8.92 | 79.70 | 65.47 | 88.14 | 3.30 |
| | Centrifuged Oil | 96.0 | 0.25 | 0.05 | 99.70 | 34.53 | 11.86 | 96.70 |
| | Calculated Feed | 100.0 | 0.69 | 0.40 | 98.90 | 100.00 | 100.00 | 100.00 |

[a]Unreacted carbon residue, ash free.
[b]Mixture of CDL and LEF.

Centrifuge experiments performed by addition of a surfactant to water and mixing it with the LEF-diluted CDL did not offer any improvement in the migration of solids into the aqueous phase.

One advantage of the present process which is evident from research results is that the water-stripping method offers some selectivity in the preferential removal of inorganic mineral matter from the suspended solids. This aspect is of special interest for application to solvent-refined coal processes intended for production of clean solid fuels. In these cases, exploiting the selective removal of the ash forming mineral matter avoids the need for total solids removal, a more difficult process step. This can be done by terminating the hydrocloning or centrifuging operations when the mineral matter (ash content) has been reduced to a suitable level, or by appropriately selecting an intermediate fraction where banks of cyclones or centrifuges or multiple-pass operations are involved.

Because the compositions and physical states of different coals and the liquefaction products thereof may vary over wide ranges, the precise degree of hydrocloning, centrifuging or other treatment to be used in the various stages of the processes disclosed or suggested herein may need to be determined empirically for each particular process to which the methods of the present invention are applied.

Typically, the process illustrated in FIG. 1 may be adapted to produce 10,000 tons per day (T/D) of a clean fuel product containing only 145 T/D of total suspended solids and only 10 T/D of ash. The input to the process consists of 12,600 T/D of coal derived liquid (CDL) containing 970 T/D of total suspended solids and 340 T/D of ash. This input is received by the mixer 11 along with 20,000 T/D of light end fraction (LEF) recycle liquid from the fractionator 12. The oleaginous mixture is fed to the separator 13 along with 70,000 T/D of the aqueous medium (stripping water), including 68,000 T/D from the thickener 24 and 2,000 T/D from the extractor 18, which is heated by a heat exchanger 22 before being fed to the separator 13. The underflow from the thickener 24 carries 825 T/D of total solids, 2600 T/D of occluded oil and 2030 T/D of water. The oil-free residue from the extractor 18 contains 825 T/D of total solids including 330 T/D of ash.

While the forms of the invention herein disclosed constitute presently preferred embodiments, many others are possible. It is not intended herein to mention all of the possible equivalent forms or ramifications of the invention. It is to be understood that the terms used herein are merely descriptive rather than limiting, and that various changes may be made without departing from the spirit or scope of the invention.

We claim:

1. A method of treating an oil derived by liquefaction of coal particles and containing unreacted solid matter to separate at least some of the unreacted solid matter therefrom and collect it in an aqueous medium, which comprises controlling the specific gravity of the oil, by mixing it with another liquid, by controlling its temperature, or both, to provide an oleaginous fluid having a substantially lower specific gravity than the aqueous medium, contacting the fluid with the aqueous medium, moving the fluid in such a manner as to provide a substantial acceleration thereto in a direction to drive at least some of the solid matter away from the fluid and into the aqueous medium, and separating the aqueous medium with the solid matter contained therein from the fluid.

2. A method as in claim 1, wherein the specific gravity controlling step comprises mixing the oil with a liquid that is miscible therewith and has a lower specific gravity.

3. A method as in claim 1, wherein the specific gravity controlling step comprises increasing the temperature of the oil to decrease its specific gravity.

4. A method as in claim 1, which comprises moving the fluid in a swirling path around an axis while maintaining a portion of the aqueous medium around at least a portion of the periphery of the path.

5. A method as in claim 1, which comprises forming an interface between the fluid and the aqueous medium, and positioning the interface so that the solid matter is driven through the interface into the aqueous medium.

6. A method as in claim 1, which comprises forming a layer of the aqueous medium with a layer of the fluid contiguous thereto, and accelerating the fluid layer to generate a force which acts to drive the particles from the fluid layer toward the aqueous layer.

7. A method as in claim 6, which comprises moving the fluid layer in a swirling path around an axis, with at least the major portion of the fluid nearer the axis and the major portion of the aqueous medium more remote from the axis.

8. A method as in claim 7, which comprises centrifuging the fluid layer.

9. A method as in claim 7, which comprises forming the layers by injecting the fluid and the aqueous medium through separate, adjacent passageways into a cyclone separator whereby the layers are accelerated.

10. A method as in claim 6, wherein the accelerating step comprises centrifuging the fluid and, along with it, the aqueous medium.

11. A method as in claim 1, wherein the aqueous medium comprises essentially water.

12. A method as in claim 2, wherein the miscible liquid comprises a light end fraction derived by fractionating the original oil.

13. A method as in claim 12 which comprises mixing about 0.5 to 6 parts by volume of the light end fraction with one part of the oil to produce the oleaginous fluid.

14. A method as in claim 2, wherein the miscible liquid comprises benzene, toluene, xylene, or kerosene.

15. A method as in claim 1, which comprises mixing about 0.5 to 3 parts by volume of benzene with one part of the oil to produce the oleaginous fluid.

16. A method as in claim 1, wherein the acceleration of the fluid is at least about 100g, where $g$ is the gravitational acceleration.

17. A method as in claim 1, wherein the acceleration is about 100g to 250g, where $g$ is the gravitational acceleration.

18. A method as in claim 1, wherein the unreacted solid matter includes both hydrocarbonaceous particles and ash particles, and the method comprises selectively removing a major portion of the ash particles from the fluid while allowing a substantial portion of the hydrocarbonaceous particles to remain in the fluid.

19. A method as in claim 18, wherein the average density of the ash particles is greater than that of the hydrocarbonaceous particles, and the selective removal comprises limiting the accelerating movement of the fluid to a predetermined level at which a major portion of the inorganic matter has been removed and while a substantial portion of the hydrocarbonaceous matter remains in the fluid.

20. A method as in claim 1, wherein the solid matter comprises denser inorganic ingredients and less dense organic matter, and the fluid is accelerated for a predetermined time until a major portion of the inorganic ingredients have been removed and while a substantial portion of the organic matter remains in the fluid.

* * * * *